US005249095A

United States Patent [19]

Hunter

[11] Patent Number: 5,249,095

[45] Date of Patent: Sep. 28, 1993

[54] LASER INITIATED DIELECTRIC BREAKDOWN SWITCH

[75] Inventor: Donald W. Hunter, Silver Spring, Md.

[73] Assignee: The United States of America as represented by the Secretary of the Army, Washington, D.C.

[21] Appl. No.: 935,718

[22] Filed: Aug. 27, 1992

[51] Int. Cl.[5] ..... F42C 19/12

[52] U.S. Cl. ..... 361/251; 102/202.5

[58] Field of Search ..... 102/202.5, 201; 361/251; 333/106

[56] References Cited

U.S. PATENT DOCUMENTS

| | | | |
|---|---|---|---|
| 4,819,560 | 4/1989 | Patz et al. | 102/202.5 |
| 4,869,170 | 9/1989 | Dahmberg et al. | 102/202.5 |
| 4,917,481 | 4/1990 | Koechner | 350/363 |
| 4,920,324 | 4/1990 | Whittaker et al. | 333/106 |
| 5,022,324 | 6/1991 | Rice | 102/201 |

*Primary Examiner*—Donald A. Griffin

*Attorney, Agent, or Firm*—Saul Elbaum; Frank J. Dynda

[57] ABSTRACT

A high voltage, laser light initiated, dielectric breakdown switch for use in safe and arm systems for initiating exploding foil initiators. One electrode has an opening which allows light from a laser source to shine on dielectric material and induce breakdown. Conduction occurs between the electrodes and transfers energy from a power supply to the electronic foil initiator.

9 Claims, 3 Drawing Sheets

LASER INITIATED DIELECTRIC BREAKDOWN SWITCH

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

The present invention is in the field of high voltage electronic switches for controllong the discharge of electrical energy from an energy storage device, typically a capacitor or other source, into a load such as an exploding foil initiator (EFI).

2. Description of the Prior Art

Functioning the exploding foil initiator (EFI) in an electronic safe and arm requires a high voltage switch to hold off the voltage on an energy storage capacitor (typically 2–3 Kv for a single EFI) and then upon triggering or initiaiton, produce a fast rise time pulse to the EFI. Typical pulse characteristics are: stored energy of 0.3 to 0.6 m Joules; rise time of 30 to 60 nanoseconds; peak current of 3 to 7 K amps; and peak power of 5 to 15 Megawatts. The most commonly used switch for this application is the ceramic body, hard brazed, miniature spark gap, with either an internal vacuum or a gas filled volume.

A spark gap for this application requires hermetic sealing, is expensive ($50 to $300), has marginal reliability and operating life, and requires an expensive high voltage trigger circuit. The only other known switch in use for this application is the explosively initiated shock conduction switch, which uses a primary explosive detonator which presents handling problems and can produce chemical contamination and possible explosive damage to surrounding electronics.

Other known types of miniature switches include the embedded electrode dielectric breakdown switch (Mound Labs MLM-MC-88-28-000), the reverse bias diode avalanche switch either electrically or light initiated (Quantic Industries and Mound Labs), and the gallium arsenide bulk conduction switch. The embedded electrode dielectric breakdown switch requires a high voltage, relatively high energy trigger pulse from an expensive trigger circuit.

The reverse bias diode avalanche switch requires a significant number of components for both the switch and trigger circuit. The gallium arsenide switch is expensive, may require hermetic sealing, and requires a high power (much more than a laser diode can provide) laser for initiation.

In contrast the invention disclosed herein, a one-shot device, is a very low cost device which does not require hermetic sealing, and can be combined with the EFI and other flexible printed circuit components. Also, the laser diode initiated dielectric breakdown switch can potentially be initiated by a low cost laser diode.

SUMMARY

This invention is a high voltage, laser initiated dielectric breakdown switch. This laser initiated switch has a dielectric material sandwiched between two electrodes. One electrode has an opening which allows light from the laser source to shine on the dielectric material and induce breakdown. Conduction then occurs between the electrodes and transfers energy from a power source (typically a capacitor) to an exploding foil initiator (EFI), or other circuit.

BRIEF DESCRIPTION OF THE DRAWING

A better understanding of the invention will be obtained when the following detailed description of the invention is considered in connection with the accompanying drawing(s) in which.

DETAILED DESCRIPTION OF THE INVENTION

Figure 1:
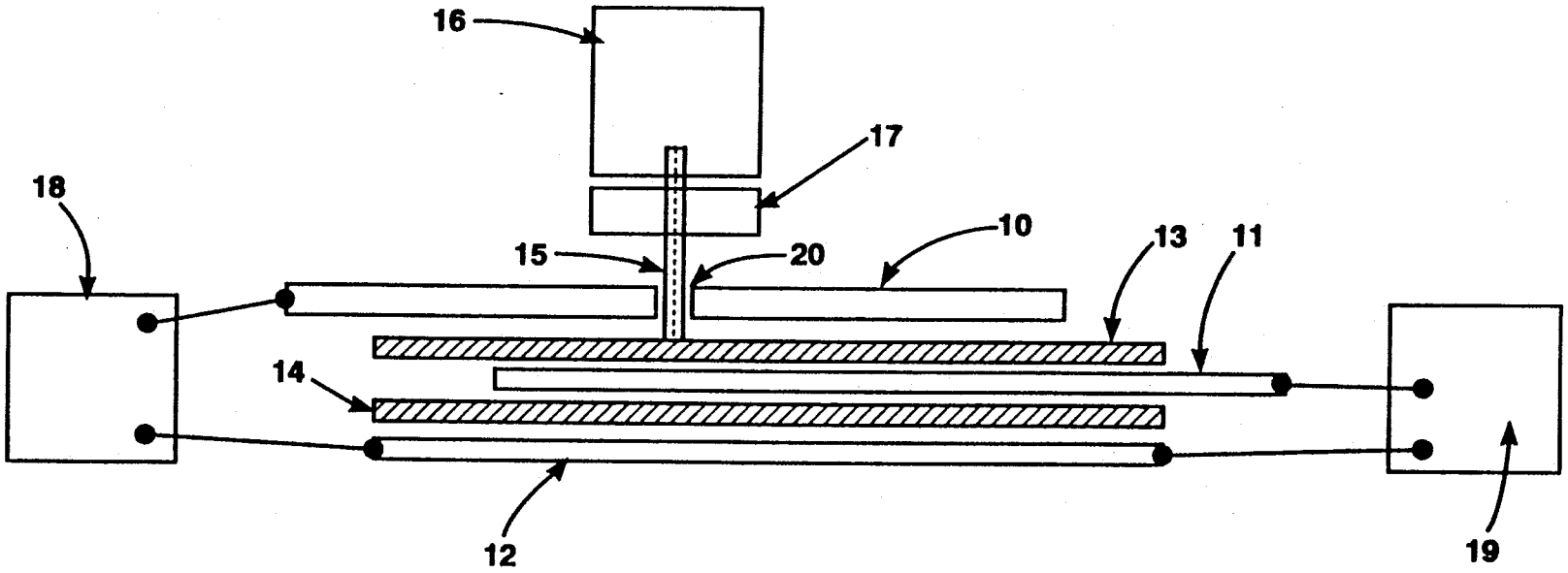
FIG. 1 shows a side view of the laser initiated dielectric breakdown switch concept.
Figure 2B:
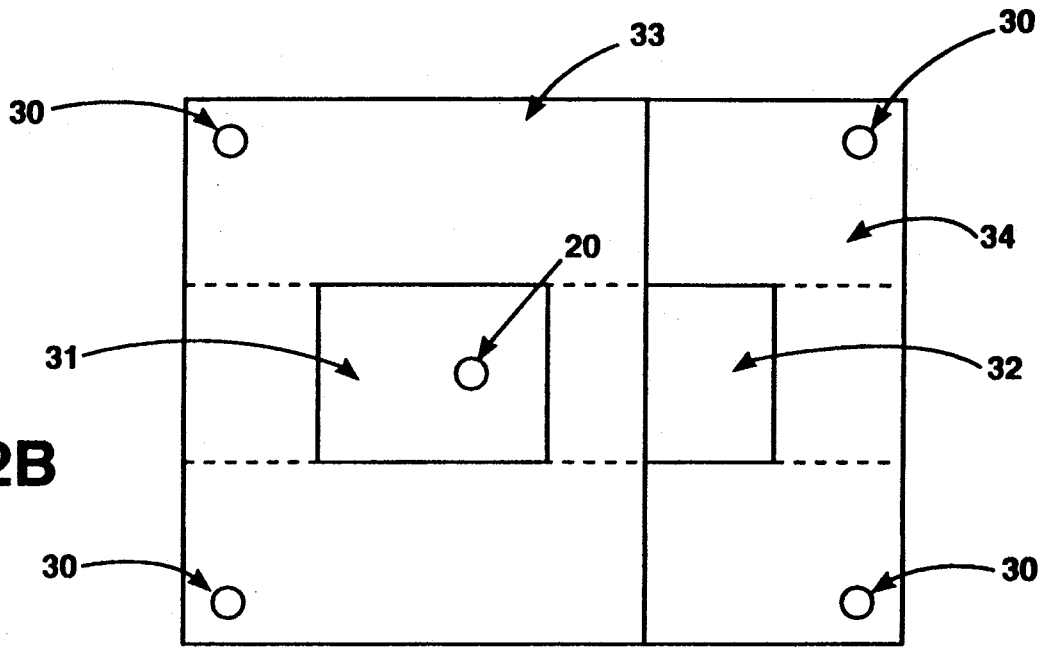
FIGS. 2A and 2B show two views of an actual prototype laser initiated dielectric breakdown switch.
Figure 2A:
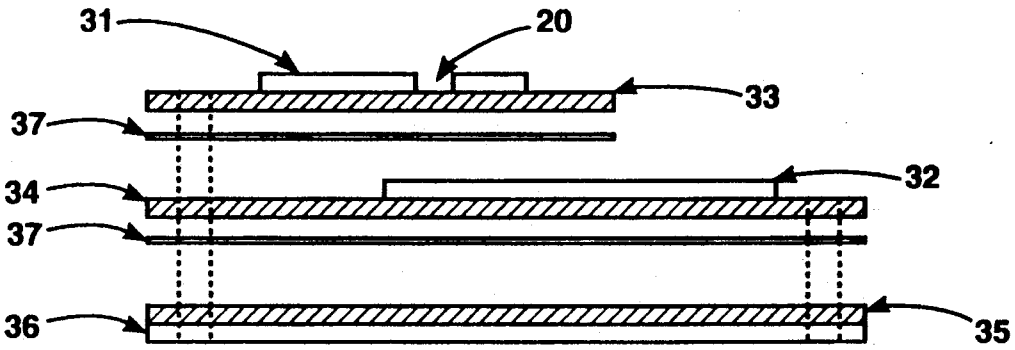
Figure 3B:
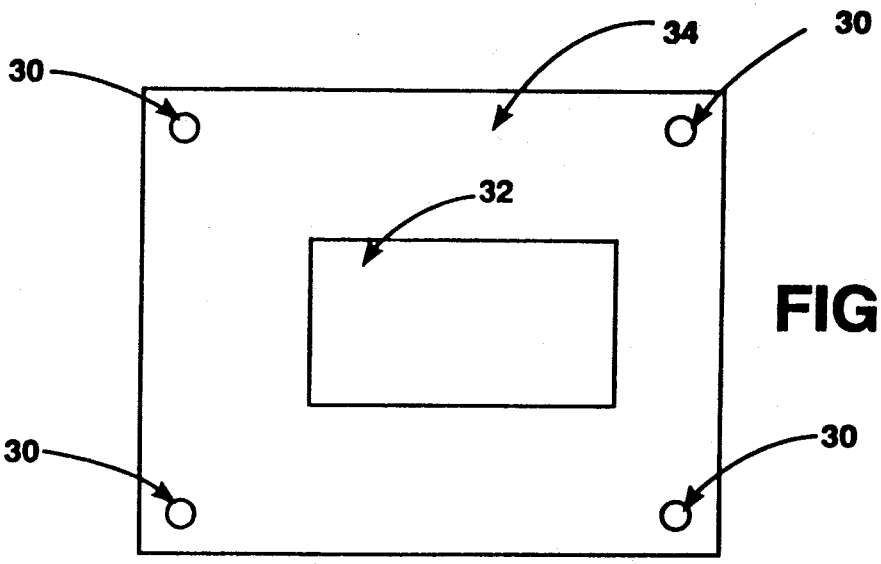
FIGS. 3A, 3B, and 3C show individual layers of the prototype switch.
Figure 3C:
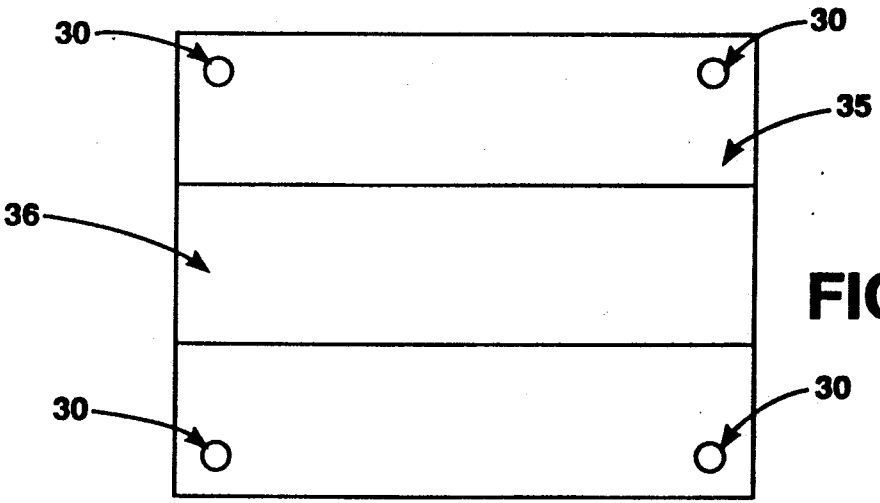
Figure 3A:
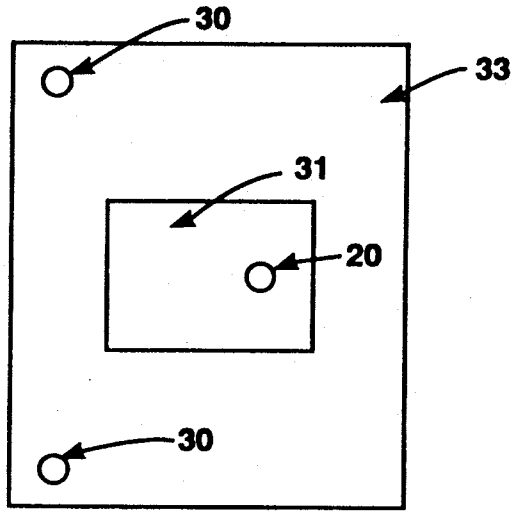

Referring to FIG. 1, the laser initiated, high voltage, dielectric switch concept is comprised of two copper electrodes, a first electrode 10, and a second electrode 11, on each side of a Kapton (Trademark) dielectric 13. A third electrode 12 is shown which can be used as a return for the current supplied to the load 19, an exploding foil initiator in this case. This third electrode 12 is not necessary, but Was used in this concept. A separate return line which is not a part of the laser initiated dielectric breakdown switch could be used instead. A high voltage power supply 18, which could be a charged capacitor, is connected to the first electrode 10 and the return or third electrode 12. A laser light source 16 is positioned above a transparent window 17, which is used to protect the laser light source 16. Aperture 20, which is an opening in the first electrode 10 allows laser light to illuminate the dielectric 13 which is positioned below the first electrode 10. FIG. 1 actually shows a complete fire set concept, used to fire an exploding foil initiator. When the laser light source operates and illuminates the dielectric 13, an initiation mechanism occurs which can include burning a hole through the dielectric 13 to reduce its thickness, and direct ionization or breakdown similar to the shock conduction effect. The initiation mechanization may be different for different dielectric materials. The laser light source is positioned so that it is aligned in a direction denoted by 15 in FIG. 1.

FIGS. 2A, 2B, 3A, 3B, and 3C show a prototype switch which was constructed into a multilayer assembly. A first copper electrode 31 on a Kapton (Trademark) dielectric 33 contains an aperture 20 to allow for laser light illumination of the dielectric 33 positioned below the electrode 31. Kapton flex print material was selected because it was available and was easily processed like printed circuit material and laminated into a multi-layer assembly. A second electrode 32 is positioned below the dielectric 33 and laminated with a glue laminate 37 which is common in the industry. A third electrode 36 is positioned below a dielectric 35 which is glued to the bottom of the dielectric 34 with flexible printed circuit adhesive 37. The copper electrodes are constructed of 1.5 to 3 mil thick copper laminate on a layer of 2 mil thick Kapton (Trademark). The flexible printed circuit adhesive is about 1 mil thick and is applied with heat and pressure applied to the multi-layer assembly. The alignment guide holes 30 are used to align the layers while heat and pressure are being applied. The distance between alignment holes 30 in FIG.

3A is about 1.1 inches to give an idea of the size of the LIDBS (laser initiated dielectric breakdown switch). The laser aperture 20 size is about 100 mils in diameter.

Tests have shown that Kapton does not absorb much in the infrared part of the light spectrum but absorbs well in the blue/green part of the spectrum. An Argon laser 16 was selected for the first tests. The laser power was varied from 5.0 Watts to 0.75 Watts with little change in peak current but with significant change in initiation time. The time from onset of laser operation to peak current was in the order of 620 microseconds for the 5 Watt laser and in the order of 4.5 milliseconds for the 0.75 Watt laser. The laser 16 spot size on the dielectric 33 was several thousandths of an inch in diameter. This was accomplished with optics standard in the industry for this type of art.

The possibilities exist of using this invention with laser diodes, initiation through a fiber optic cable, inclusion of pyrotechnic material to enhance initiation, and integrating the LIDBS with other components to program warhead and other functions.

Having described this invention, it should be apparent to one skilled in the art that the particular elements of this invention may be changed, without departing from its inventive concept. This invention should not be restricted to its disclosed embodiment but rather should be viewed by the intent and scope of the following claims.

What is claimed is:

1. A laser initiated dielectric breakdown switch (LIDBS) comprising:

a dielectric material sandwiched between a first electrode and a second electrode, a laser light source positioned adjacent to an aperture in said first electrode, wherein operation of said laser light source causes said dielectric material sandwiched between said first electrode and said second electrode to allow conduction of electricity between said first electrode and said second electrode.

2. A laser initiated dielectric breakdown switch as in claim one wherein said dielectric material is made of KAPTON (Trademark).

3. A laser initiated dielectric breakdown switch as in claim one comprising a transparent window between said laser light source and said first electrode to protect said laser light source.

4. A laser initiated dielectric breakdown source as in claim one further comprising a high voltage power supply connected to said first electrode and an exploding foil initiator (EFI) connected to said second electrode wherein operation of said laser initiated dielectric breakdown switch causes said high voltage power supply to discharge through said exploding foil initiator thereby operating said exploding foil initiator.

5. A laser initiated dielectric breakdown switch as in claim one further comprising a third electrode sandwiched to said second electrode with a dielectric material in between said second electrode and said third electrode wherein said third electrode serves as a return conductor for said first electrode.

6. A laser initiated dielectric breakdown switch as in claim one wherein said laser light source is a laser diode.

7. A laser initiated dielectric breakdown switch as in claim one wherein said laser light source comprises an infrared laser.

8. A laser initiated dielectric breakdown switch as in claim one wherein said laser light source comprises a fiber optic light source.

9. A laser initiated dielectric breakdown switch as in claim one wherein said switch is combined with an EFI and a high voltage fire set capacitor to comprise an integrated flexprint fire set.

* * * * *